United States Patent [19]

Gauthier

[11] 4,284,268

[45] Aug. 18, 1981

[54] PATIENT SUPPORT TABLE WITH ADJUSTABLE STIRRUPS

[75] Inventor: Robert O. Gauthier, Two Rivers, Wis.

[73] Assignee: American Hospital Supply Corporation, Evanston, Ill.

[21] Appl. No.: 67,597

[22] Filed: Aug. 17, 1979

[51] Int. Cl.[3] ..... A61G 13/00

[52] U.S. Cl. ..... 269/328

[58] Field of Search ..... 269/328

[56] References Cited

U.S. PATENT DOCUMENTS

| | | | |
|---|---|---|---|
| 490,540 | 1/1893 | Case | 269/328 |
| 3,100,129 | 8/1963 | Adolphson | 269/328 |
| 3,334,951 | 8/1967 | Douglass et al. | 269/328 |
| 3,409,287 | 11/1968 | Chervenka | 269/328 |

FOREIGN PATENT DOCUMENTS

| | | | |
|---|---|---|---|
| 881157 | 11/1961 | United Kingdom | 269/328 |

*Primary Examiner*—Robert C. Watson

*Attorney, Agent, or Firm*—Larry N. Barger

[57] ABSTRACT

A medical examination table which has a pair of foot stirrups that are supported and moved by a pair of limb support bars. These limb support bars are longitudinally slidable within independent swivel collars within the table. A swivel lock means is disclosed for locking the limb support bars in a particular angular position, and there is also lock means disclosed for holding each bar at a particular length adjustment.

16 Claims, 5 Drawing Figures

PATIENT SUPPORT TABLE WITH ADJUSTABLE STIRRUPS

BACKGROUND

U.S. Pat. No. 2,714,541 describes a physician examination table in which stirrups are longitudinally slidable along a leg support bar 23 for adjusting the longitudinal length of the stirrups. Such construction has a tremendous disadvantage in that when the stirrups are adjusted very close to the examination table, the protruding ends of the supporting bars 23 can be continually bumped into by the physician as he moves about examining the patient. Although these foot support bars 23 can swivel from side to side as shown in the FIG. 5 embodiment, they are of a constant length. When not in use, they can be swung downwardly and tucked beneath the table top, as shown in FIG. 5.

U.S. Pat. No. 3,318,596 describes a surgical table with an elaborate motor system for swinging the leg supports outwardly, such as for gynecology examinations. However, both leg supports are pivotally pinned, as shown in FIG. 2 at 16 to transverse rod 15. Although rod 15 can move forwardly and rearwardly a very short distance in slot 19, this gives no adequate nor independent adjustment to the leg supports. Both leg supports move forwardly and rearwardly together as rod 15 is moved. This is a serious disadvantage in that sometimes a physician will want one leg in an extended stirrup while the other one is in a retracted stirrup for a particular examination position of the patient.

The assignee of the present application also is the assignee of U.S. Pat. No. 3,871,637. In FIGS. 1 and 2 of this patent, there appears to be a slight horizontal swinging motion of limb support bar 25 when compared to FIG. 2. The table described in this patent has no mechanism for combined lateral swinging and longitudinal sliding. As explained in the specification of this patent, the limb support bar structure (hidden from view) is the same as disclosed in Ser. No. 329,380 which later became U.S. Pat. No. 3,944,205. It is clear from such reference disclosure that the limb support bars slide only longitudinally and do not laterally swivel. Such reference does not describe any structure within the table for supporting or controlling lateral swivel and longitudinal motion.

SUMMARY OF THE INVENTION

The present invention overcomes the problems described above and provides a unique support structure for simultaneous movement of a limb support bar in a lateral swivel direction and also in a longitudinal sliding direction. The structure includes a pair of swivel supports that can independently swivel in a horizontal direction, and a limb support bar longitudinally slidable in such swivel support. Preferably, a limb receiver or stirrup is secured to the limb support bar at a fixed location so as to move with the limb support bar. Preferably, the swivel support is a pivoting collar which slidingly receives the limb support bar, and can be hidden from view within the table.

THE DRAWINGS

DETAILED DESCRIPTION

Figure 1:
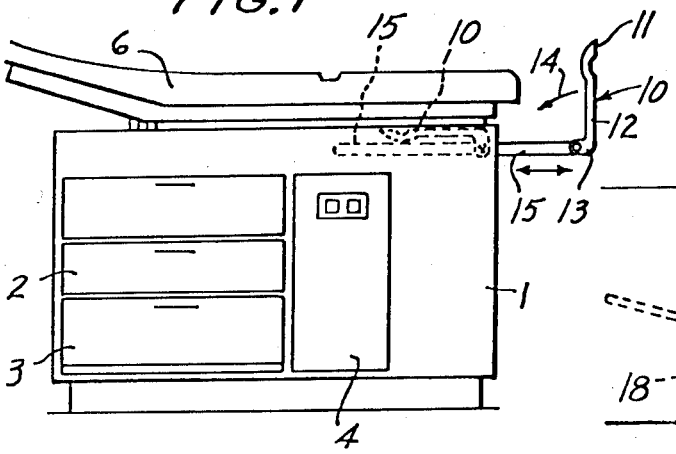
FIG. 1 is a side elevational view of a patient examination table.

In FIG. 1, a patient examination table is shown with a body 1 that can have a series of drawers such as 2 and 3. An accent panel 4 can include an electrical outlet as shown on the panel's upper portion. A patient cushion 6 can have 1 or more elevating sections. Other constructions of the examination table could be used for connection with the adjustable limb support structure which forms the basis for the present invention.

A foot stirrup, shown generally at 10, can include a foot cup section 11, an upstanding column member 12, and a pivot member 13. As shown by the curved arrow 14, the stirrup can fold down against a limb supporting bar 15. The limb supporting bar 15 can then be longitudinally pushed into a recess in body 1 of the examination table, as shown in dotted line in FIG. 1.

Figure 2:
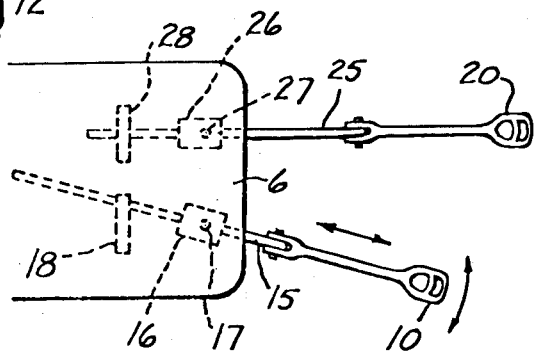
FIG. 2 is a fragmentary top view of the right end of the patient examination table of FIG. 1 showing different positions of the foot stirrups and limb support bars.

It is often the case that the physician desires to independently adjust the foot stirrups both in a lateral swivel position and in a longitudinal length position. Heretofore, the structure of such limb support bars and stirrups did not lend themselves to this particular adjustment. As shown in FIG. 2, limb support bar 15 can be moved longitudinally and pivotally. Hidden within the table is a swivel collar 16 with a pivot member 17. A swivel lock construction 18 holds the angular position of the limb support bar 15. Longitudinal movement of the limb support bar 15 is accomplished by the sliding relationship within swivel collar 16. The structure of the swivel lock 18 also permits this longitudinal sliding. A pin 50 can abut the swivel lock 18 to prevent the support bar from being pulled out of the table.

As can be seen from the structure shown in FIG. 2, the foot stirrup 10 can be moved to practically any desired position within a generally horizontal plane. It is important to note that the stirrup can always be at the end of the limb support bar 15 so that the physician is not continually bumping into a long exposed bar when the stirrup is adjusted to a short position, as is the right stirrup of FIG. 2.

The left stirrup 20 is also supported by a similarly adjustable limb support bar 25 which is longitudinally slidable in swivel collar 26 that has a pivot pin 27. A swivel lock 28 is similar to a swivel lock of 18. Thus, either limb support bar can be independently lengthened, shortened, swiveled sideways, or placed in parallel relationship with the other limb support bar. This provides great flexibility to the examining physician.

Figure 3:
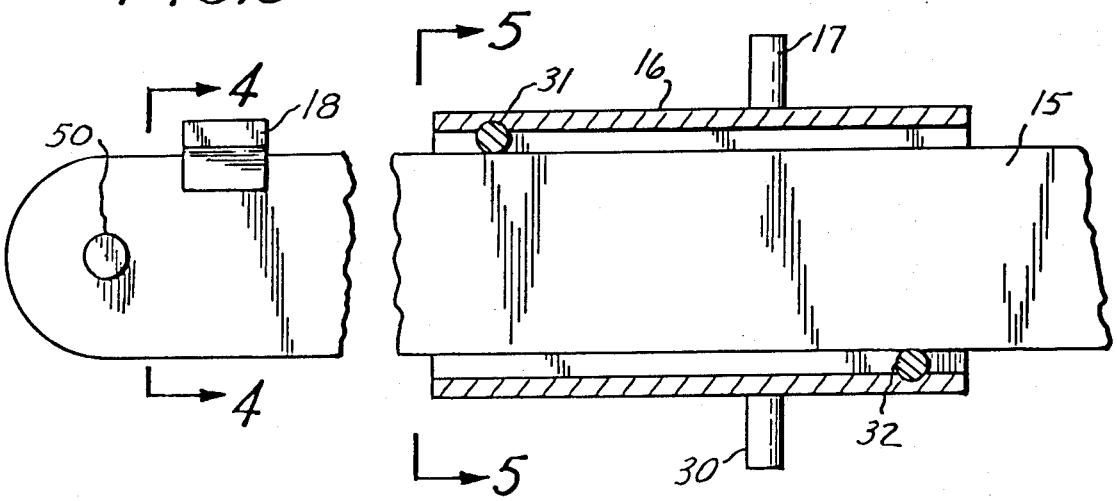
FIG. 3 is an enlarged fragmentary view of the limb support bar longitudinally slidable in its swivel collar.
Figure 4:
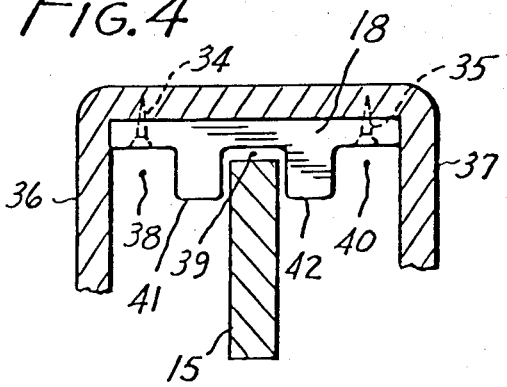
FIG. 4 is a view taken along line 4—4 of FIG. 3 showing the swivel lock construction.
Figure 5:
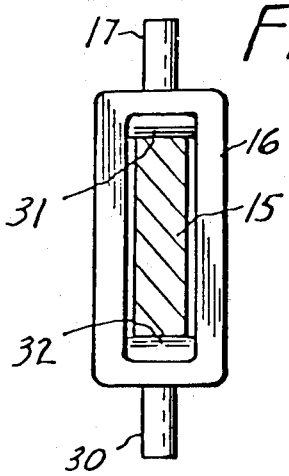
FIG. 5 is a view taken along line 5—5 of FIG. 3 showing the longitudinal lock structure.

The enlarged fragmentary view of the limb support bar 15, as shown in FIG. 3, perhaps best shows the relationship of the limb support bar 15 and swivel collar 16. The swivel collar can have a generally rectangular shape with pivot means 17 and 30 which engage structure on the table. Other types of pivot means could be used, if desired. The swivel collar has a transverse pin 31 at an upper rear portion and a transverse pin 32 at a lower front portion. Thus, as the patient applys the weight of the limb downwardly on the outer end of limb support bar 15, pins 31 and 32 cause a wedging action on the limb support bar 15. This causes the limb support bar 15 to longitudinally lock to the swivel collar 16. Simply by lifting up on the outer end of limb support bar 15, the wedging or locking action is disengaged and can slide in swivel collar 16.

The pivot locking mechanism is shown generally at 18 in FIG. 3. Member 18 is preferably secured as by screws 34 and 35 to table structure that includes depending sections 36 and 37. Thus, a series of slot-like apertures 38, 39, and 40 are created adjacent depending teeth-like members 41 and 42. Alternatively, depending members 36 and 37 could be integrally formed with stop member 18. Also, a different number of adjustment slots could be provided. Three adjustment slots are shown in the present embodiment of the invention. It is also preferred to include a slight gap, as shown at numeral 39, so that the swivel stop 18 does not interfere with the longitudinal wedging action of pins 31 and 32.

For smooth sliding action, it is preferable to make the swivel stop member 18 of a lubricious thermoplastic material such as high density polyethylene. For strength requirements, the swivel collar 16, limb support bar 15, and stirrup 10 are made of a metal material, as are wedge pins 31 and 32. As shown in the drawings, the complete structure of the swivel collar, swivel lock, and longitudinal lock are completely encased within the body 1 of the examination table and there is no involved mechanism at the outer end of the foot stirrup structure.

In the foregoing description, a specific example has been used to describe the present invention. However, it is understood by those skilled in the art that certain modifications can be made to this example without departing from the spirit and scope of the invention.

I claim:

1. A patient support table wherein the improvement comprises: a pair of swivel supports that can independently swivel in a generally horizontal direction; a limb support bar connected to each swivel support at a longitudinally sliding joint; a limb receiver secured at a fixed location to each limb support bar; and wedge means on each swivel support for longitudinally adjusting the effective length of the limb support bar; and a swivel lock on the table slidingly receiving each bar with sufficient clearance to permit a wedging action between the bar and swivel support, whereby the bar is locked against both longitudinal and swivel motion when a patient's limb is placed on the limb receiver.

2. A patient support table as set forth in claim 1, wherein the limb receiver is a stirrup.

3. A patient support table as set forth in claim 2, wherein the stirrup is foldably connected to the limb support bar.

4. A patient support table as set forth in claim 1, wherein the swivel supports are concealed within the table.

5. A patient support table wherein the improvement comprises: a swivel collar pivotally connected to the table to swivel in a generally horizontal direction; a limb support bar slidingly received in the swivel collar; a limb receiver connected to the limb support bar; wedge means on the swivel support for longitudinally adjusting the effective length of the limb support bar; and a swivel lock on the table slidingly receiving the bar with sufficient clearance to permit a wedging action between the bar and swivel support, whereby the bar is locked against both longitudinal and swivel motion when a patient's limb is placed on the limb receiver.

6. A patient support table as set forth in claim 5, wherein the limb receiver is a stirrup fixedly attached to the limb receiver.

7. A patient support table as set forth in claim 6, wherein the stirrup is pivotally attached to the limb support bar.

8. A patient support table as set forth in claim 5, wherein the swivel supports are concealed within the table.

9. A limb positioning assembly as set forth in claim 8, wherein the limb receiver is a stirrup.

10. A limb positioning assembly as set forth in claim 9, wherein the stirrup is pivotally attached to the limb support bar.

11. A limb positioning assembly for attachment to a patient support table, which limb positioning assembly comprises: a swivel collar with pivot means; a limb support bar slidingly received in the collar; a limb receiver connected to the limb support bar so as to be movable with the limb support bar through various angular and length adjustments; wedge means on the swivel support for longitudinally adjusting the effective length of the limb support bar; and said assembly includes a swivel lock to slidingly receive the bar with sufficient clearance to permit a wedging action between the bar and swivel supports, whereby the bar is locked against both longitudinal and swivel motion when a patient's limb is placed on the limb receiver.

12. A limb positioning assembly as set forth in claim 11, wherein the stirrup is fixedly attached to the limb support bar.

13. A patient support table wherein the improvement comprises:

a pair of swivel supports that independently swivel in a generally horizontal direction; a limb support bar connected to each swivel support at a longitudinally sliding joint; which table includes a swivel lock means for each swivel support, and such swivel lock means has a plurality of downwardly facing slots for slidingly engaging the limb support bar at different angular positions of the swivel support; and a limb receiver secured at a fixed location to each limb support bar.

14. A patient support table as set forth in claim 13, wherein the swivel lock means has slots that have an open tooth construction for engaging the limb support bar.

15. A patient support table wherein the improvement comprises: a pair of swivel supports that can independently swivel in a generally horizontal direction; a limb support bar connected to each swivel support at a longitudinally sliding joint; a limb receiver secured at a fixed location to each limb support bar; and a longitudinal lock means responsive to a patient's limb weight on each limb support bar; and such lock means includes a first transverse wedge member to engage a top of its limb support bar, and a second transverse wedge member to engage a bottom of its limb support bar at a location forward of the first wedge member.

16. A patient support table as set forth in claim 15, wherein the transverse wedge members are protruding pins.

* * * * *